US005411375A

United States Patent [19]

Bauer

[11] Patent Number: 5,411,375

[45] Date of Patent: May 2, 1995

[54] INTAKE CONTROL VALVE

[75] Inventor: Friedrich Bauer, Wien, Austria

[73] Assignee: Hoerbiger Ventilwerke Aktiengesellschaft, Wien, Austria

[21] Appl. No.: 69,386

[22] Filed: Jun. 1, 1993

[30] Foreign Application Priority Data

Jun. 2, 1992 [AT] Austria ..... 1137/92

[51] Int. Cl.[6] ..... F04B 49/00

[52] U.S. Cl. ..... 417/295; 417/298; 137/492.5; 137/907; 251/83

[58] Field of Search ..... 417/295, 298, 446, 447, 417/559; 137/492.5, 513.7, 907; 251/83

[56] References Cited

U.S. PATENT DOCUMENTS 862,867 8/1907 Eggleston .
3,982,561 9/1976 Harthun ..... 251/83
4,708,599 11/1987 Suzuki .
4,826,134 5/1989 Chapman .
4,968,221 11/1990 Noll ..... 417/295

FOREIGN PATENT DOCUMENTS 0391064 10/1990 European Pat. Off. .
0587917 5/1947 United Kingdom ..... 417/295

*Primary Examiner*—Richard A. Bertsch
*Assistant Examiner*—William Wicker
*Attorney, Agent, or Firm*—Watson, Cole, Grindle & Watson

[57] ABSTRACT

An intake control valve for a screw-type compressor is built into the intake line, which it alternatingly opens or closes. The intake control valve, designed as a double seat valve, has a locking body (17), to which are assigned two opposing valve seats, namely a return flow seat (7) and an intake seat (9). Upon starting the screw-type compressor, the locking body (17) is pulled onto the intake seat (9) by means of the resulting intake pressure. As soon as a specific operating pressure is reached, the locking body (17) is lifted from the intake seat (9) by means of the pressure medium by way of a control cylinder (10) with a control piston (11) and moved into an intermediate position between its two seats (7, 9), so that the screw-type compressor can totally transport. As soon as the screw-type compressor is turned off, a weak spring (18) braced against the valve housing (1) pushes the locking body (17) onto the return flow seat (7) and closes it sealingly, so that neither pressure medium nor oil injected for lubricating the screw-type compressor can flow back into the intake line.

5 Claims, 1 Drawing Sheet

INTAKE CONTROL VALVE

BACKGROUND OF THE INVENTION

1. Field of the Invention

The invention relates to an intake control valve for a screw-type compressor, in particular for a screw-type compressor with oil injection, which is built into the intake line of the screw-type compressor and includes a locking body which alternatingly opens or closes the intake line and is operationally connected to a control piston or a control diaphragm which can be displaced in a cylinder and which can be pressurized with a pressure medium in the opening direction of the intake line.

2. The Prior Art

Various designs of such an intake control valve are known. The simple models of screw-type compressors are "normally open," i.e., in the pressureless state of the screw-type compressor the intake control valve releases the cross-sectional area of passage of the intake line. Thus, the screw-type compressor starts with an open intake control valve, thus immediately loading the driving motor owing to the entire work of compression. Not until adequate operating pressure has been built up can the intake control valve be totally or partially closed in order to reduce the quantity being transported. Thus, the drawback with this design is that the driving motor is heavily loaded and with frequent starts in the unit of time is also overloaded.

Overloading the driving motor when starting is avoided by means of the other prior art intake control valves of the "normally closed" type. In this known design the intake control valve is held closed by means or spring force. After starting the screw-type compressor, the pressure builds up significantly more slowly and correspondingly there is a smaller load on the driving motor. To accelerate pressure buildup, it has also already been known to design the closed intake control valve so as to leak, e.g., by means of a bore or a channel bypassing the valve.

As soon as a specific operating pressure is reached, the spring force holding the intake control valve closed has to be overcome in this prior art design, a process that usually takes place by means of a differential piston. The piston area of the differential piston has to be correspondingly large, because the force exerted by the piston has to overcome, on the one hand, the spring force acting on the intake control valve and, on the other hand, the gas pressure acting on the intake control valve in the closing direction by means of the built up operating pressure, additionally also the increase in the spring force as a consequence of the spring rate. Thus, it involves relatively large forces, because to guarantee a faultless function the spring force must be positively greater than the intake force of the screw-type compressor and the gas pressure must be positively greater than the spring force.

An intake controlling device of this kind is known from DE-OS 29 44 053. This device has a relatively complicated locking body which controls the intake line and which in the closing direction is spring-loaded and in the opening direction is pressurized by the pressure generated by the screw-type compressor. When the screw-type compressor is started, the spring force is overcome by the pressure building up and the intake line is opened. The cross-section of the direct flow is changed to control the amount to be transported with the aid of another control piston, which is pressurized by a control pressure, e.g., the network pressure and loads the closing body in the direction of the spring force, so that the operating pressure applied to the opposing side of the closing body is overcome.

Common to all of these known intake control valves is that they close against the direction of flow of the gas that has been taken in and have to be held closed against the intake-sided negative pressure. The result is automatically a complicated construction, which is associated with high procurement costs and can cause breakdowns. In addition, the closing spring of the locking body, locking the intake line, causes pressure losses, thus reducing the possible maximum delivery of the screw-type compressor.

SUMMARY OF THE INVENTION

This invention is based on the object of simplifying the construction of the known intake control valves and yet improving them in such a manner that they can be operated with very little strength without detracting from the function.

This problem is solved with the invention by the fact that the intake control valve, designed as a double seat valve, is provided with an intake seat, which closes the locking body in the intake direction, and with a return flow seat, which closes the locking body against the intake direction, and that the locking body between the two seats exhibits an intermediate position, defined by a final position of the control piston or the control diaphragm, in which position at least approximately the largest cross-sectional area of throughflow is opened by the intake control valve and from which position, as the non-return valve, it can be freely set against the return flow seat. With the design of the intake control valve as a double seat valve with a rigidly defined intermediate position, a surprisingly simple construction and additionally an advantageous operation is achieved. When starting the screw-type compressor, the intake control valve according to the invention is closed by the intake-sided negative pressure; and, following build up of an operating pressure by means of the pressure medium acting on the control piston or the control diaphragm, the intake control valve is opened as far as into the intermediate position between the two seats.

The locking body of the intake valve is raised to the half stroke between its two seats and opens in this position the entire intake cross-section. The control piston or the control diaphragm has to overcome only the week spring force of its restoring spring end the intake force. If the compressor is turned off, the locking body of the intake control valve, which acts then as a non-return valve, is pushed onto the return flow seat, which it closes independently of the position of the control piston or the control diaphragm. Immediately after starting the screw-type compressor again, the negative pressure sucks the locking body over its entire stroke to the intake seat and closes it, so that the intake control valve perceives then the "normally closed" function. Thus, the driving motor is prevented from being overloaded.

In a preferred embodiment of the invention, the locking body is loaded by a weak spring, which is braced against the housing and which acts in the direction of the return flow seat on it. When the screw-type compressor is turn off, this spring supports the closing movement of the locking body in the direction of the return flow seat and ensures that it is rapidly and completely sealed, so that the pressure medium and the oil mist dragged along in it are reliably prevented from flowing back into the intake line.

In another embodiment of the invention a channel bypassing the intake seat can be provided with a small cross-section. This channel causes in a well-known manner the pressure not to build up too slowly when the intake seat of the intake control valve is closed, thus during the startup phase of the screw-type compressor, and causes the lubrication of the screw-type compressor through injection of oil to start on time. Instead of the bypass channel, the intake seat of the intake control valve can also be designed so as to leak.

According to another advantageous feature of the invention, the control piston can be arranged in a control cylinder, which mounted in the axis of the valve housing of the intake control valve in it and around which transported medium flows. It involves a space-saving arrangement of the control cylinder with a simple, linear transfer of force to the locking element of the intake control valve.

Other details and advantages of the invention follow from the subsequent description of the embodiments, which are depicted in the drawings.

DETAILED DESCRIPTION OF THE PREFERRED EMBODIMENTS

Figure 1:
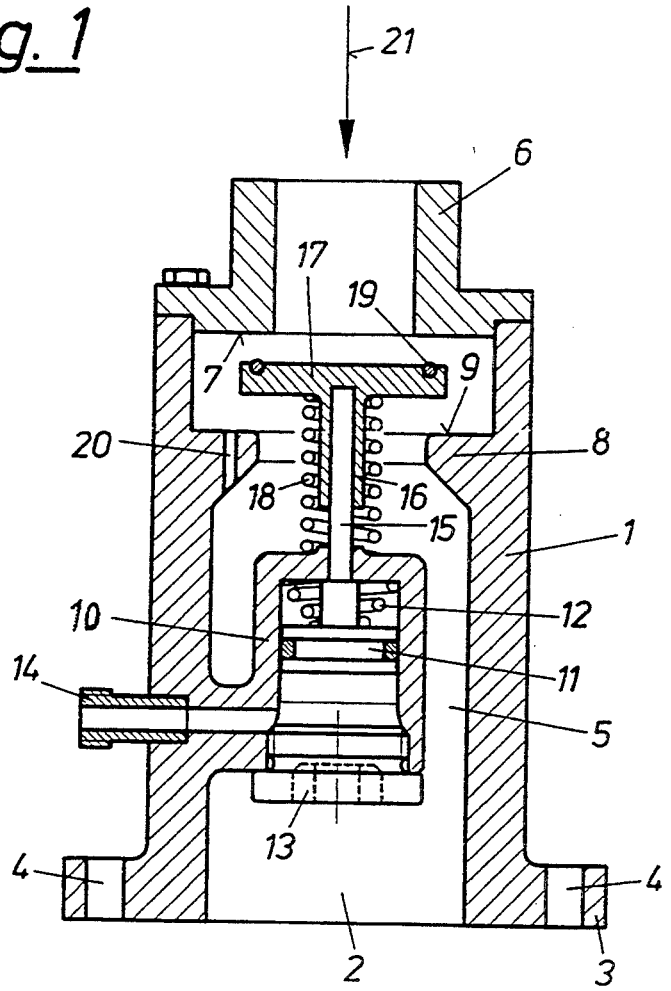
FIGS. 1 and 2 are longitudinal sectional views of two different embodiments of the intake control valve according to the invention.

Both embodiments comprise a hollow valve housing 1 or 1', which is connected with a connecting opening 2 to the inlet of a screw-type compressor (not shown). For this purpose, in the embodiment according to FIG. 1, a flange 3 is provided with attachment bores 4 for flange bolts. The valve housing 1 exhibits a flow channel 5, to which is attached the intake line 6 at the other end of the housing. At the end of the intake line 6 a return flow seat 7 is formed and at some distance from it the valve housing 1 exhibits an inwardly protruding collar 8, which forms an intake seat 9 opposite the return flow seat 7.

Inside the valve housing 1, which can be designed as a casting, there is in the embodiment according to FIG. 1 a control cylinder 10, in which a control piston 11 can be moved against the force of a reset spring 12. The open end of the control cylinder 10 is closed by a screw lid 13, above which a control attachment 14 opens into the control cylinder 10. The control piston 11 is guided out of the control cylinder 10 with a rod 15; a shoulder 16 of a disk-shaped locking body 17 is mounted moveably on the free end of the control cylinder, the shoulder being provided with a bore. A weak helical spring 18, which loads the locking body 17 against the return flow seat 7, is braced against the housing of the control cylinder 10. The locking body 17 exhibits a seal 19, which causes a tight closure of the return flow seat 7. In contrast, the collar 8 has a channel 20, which bypasses the intake seat 9 of the intake control valve and thus represents a leakage of the intake seat 9.

Figure 2:
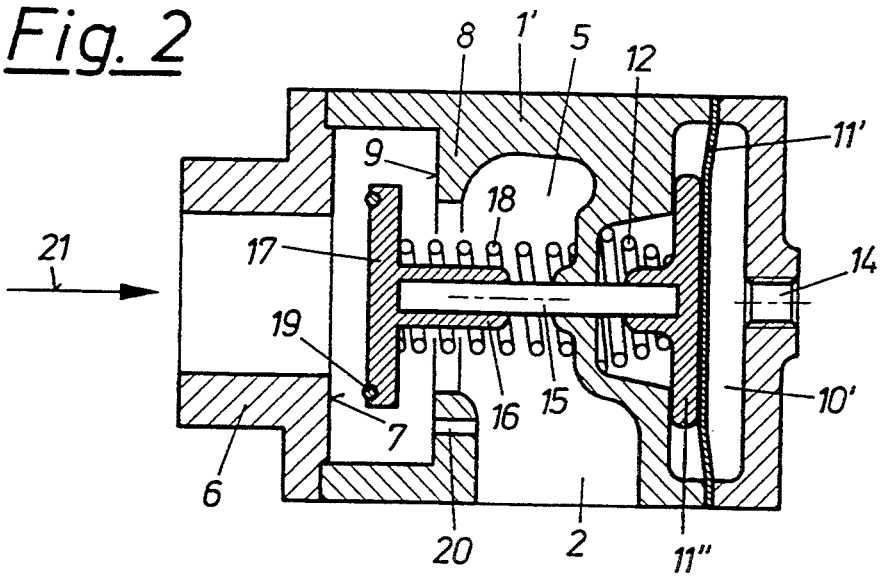

In the embodiment according to FIG. 2, the intake control valve is designed as an angle valve; and to adjust the locking body 17 a control diaphragm is provided that is denoted as 11'. As in the design according to FIG. 1, one end of the housing 1' is connected to the intake line 6; the flow channel 5 opens, however, on the side of the housing 1' and is attached there in a manner, which is not shown in detail, to the inlet of a screw-type compressor.

The diaphragm 11' is clamped into a pressure chamber 10', which is provided with a control attachment 14, and acts on a diaphragm disk 11'', which is loaded by the reset spring 12. In addition, the rod 15, on which the hollow extension 16 of the locking body 17 is mounted, is attached to the diaphragm disk 11''. Thus, here, too, the locking body 17 can be moved virtually freely relative to the control diaphragm 11', resulting in merely a drag connection between the rod 15 and the locking body 17 in the opening direction of the intake seat 9, and in particular as far as into an intermediate position between the intake seat 9 and the return flow seat 7. In this intermediate position, which is exactly defined by the stop of one part of the control piston 11 at the control cylinder 10 (FIG. 1) or of the diaphragm disk 11'' at the valve housing 1 (FIG. 2), the cross-sectional area of throughflow is totally opened by the intake control valve and is the largest.

In both embodiments the rod 15 is coordinated with the piston 11 or the diaphragm 11' displacing the rod, so that the rod can move the locking body 17 only as far as into the intermediate position between the intake seat 9 and the return flow seat 7. Thus, the locking body 17 cannot be pressed by the control piston 11 or the control diaphragm 11' against the return flow seat 7, even at high operating pressure. The return flow seat is closed by the locking body 17 only as a freely adjustable non-return valve, as soon as the screw-type compressor stops conveying, and in particular by means of the force, exerted on it by the compressed medium, with support from the spring 18.

The medium conveyed by the screw-type compressor (not illustrated here) is sucked in the direction of arrow 21 through the flow channel 5 of the intake control valve. Upon operating the screw-type compressor, the locking body 17 of the intake control valve is situated in the intermediate position shown in both figures approximately in the middle between the return flow seat 7 and the intake seat 9, resulting in the locking body releasing the entire cross-sectional area of throughflow through the flow channel 5. When the compressor is turned off, the helical spring 18 presses the locking body 17 without delay against the return flow seat 7, which is totally sealed with the aid of the seal 19. Thus, the compressed medium is prevented from flowing back into the intake line 6, and in particular the oil, injected to lubricate the compressor, is prevented from escaping into the intake line 6.

In addition, the helical spring 18 brings about that the return flow seat 7 remains closed even if later the screw-type compressor becomes pressureless. When the screw-type compressor is without pressure, the control piston 11 or the control diaphragm 11' is subject to the effect of the reset spring 12 in the bottom final position, in which the rod 15 is pulled back as far as possible into control cylinder 10 or into the pressure chamber 10'.

When the screw-type compressor is subsequently started, the resulting negative pressure brings about that the locking body 17 is lifted from the return flow seat 7 and moved as far as to making contact with the intake seat 9. This movement is not prevented by the relatively short rod 15, which is pulled back into the interior of the control cylinder 10 or the pressure chamber 10'. In this position the intake control valve perceives its "normally closed" function. In this phase the medium conveyed by the screw-type compressor is sucked in through the small channel 20, which can be calibrated, so that the compressor is raised in the desired slow manner to the operating pressure, for example a pressure tank attached to the screw-type compressor is pumped up.

As soon as the desired pressure is attained, the control attachment 14 is put under pressure by way of a two point controller and thus the control piston 11 or the control diaphragm 11' is pressurized with pressure medium, whereupon the rod 15 of the locking body 17 is lifted from the intake seat 9 and moved into the intermediate position shown in the drawing. By selecting the pressure of the medium conveyed through the control attachment 14, it is also possible to lift the locking body 17 more or less from the intake seat 9 and thus to regulate steplessly the amount of medium sucked in by the screw-type compressor.

I claim:

1. A non-return intake valve which is attachable to a screw compressor, said intake valve comprising:

a body which defines a first portion, a second portion and an internal fluid flow channel that extends from said first portion to said second portion to enable fluid to flow therethrough in an intake direction into a screw compressor, first valve seat means in said fluid flow channel in said first portion of said body, second valve seat means in said fluid flow channel between said first valve seat means and said second portion of said body, a control cylinder located in said fluid flow channel, and a control fluid passage leading to said control cylinder, and a valve element which includes a control piston movable in said control cylinder, a locking element located in said fluid flow channel between said first valve seat means and said second valve seat means, and a rod extending between said control piston and said locking element, flow of control fluid through said control fluid passage into and out of said control cylinder determining the positioning of said control piston in said control cylinder and, with fluid flowing through said fluid flow channel in said intake direction from said first portion to said second portion of said body, whether said locking element is located against said second valve seat to tend to block fluid through said fluid flow channel or at a predetermined position between said first valve seat and said second valve seat to allow approximately the largest cross-sectional area of fluid flow through said fluid flow channel, stop means in the form of interengaging surfaces on said control piston and a portion of said body for limiting movement of said control piston and said rod in a direction toward said first valve seat means, said predetermined position being established by said stop means, said locking element being axially movable relative to said rod to enable said locking element to move against said first valve seat and prevent fluid flow through said fluid flow channel in a direction reverse to said intake direction.

2. A non-return intake valve according to claim 1, including a spring in said control cylinder to bias said control piston into a position wherein said locking element can be located against said second valve seat.

3. A non-return intake valve according to claim 1, wherein said body defines a bypass channel for fluid flow around said second valve seat.

4. A non-return intake valve according to claim 1, wherein said body comprises a valve housing and a portion of an intake line attached thereto.

5. A non-return intake valve which is attachable to a screw compressor, said intake valve comprising:

a body which defines a first portion, a second portion and an internal fluid flow channel that extends from said first portion to said second portion to enable fluid to flow therethrough in an intake direction into a screw compressor, first valve seat means in said fluid flow channel in said first portion of said body, second valve seat means in said fluid flow channel between said first valve seat means and said second portion of said body, a control chamber means within said body, and a control fluid passage leading to said control chamber means, and a valve element which includes a diaphragm disk movable in said control chamber means, a diaphragm which extends across said control chamber means between said diaphragm disk and said control fluid passage, a locking element located in said fluid flow channel between said first valve seat means and said second valve seat means, and a rod extending between said diaphragm disk and said locking element, flow of control fluid through said control fluid passage into and out of said control chamber means determining the positioning of said diaphragm disk in said control chamber means and, with fluid flowing through said fluid flow channel in said intake direction from said first portion to said second portion of said body, whether said locking element is located against said second valve seat to tend to block fluid through said fluid flow channel or at a predetermined position between said first valve seat and said second valve seat to allow approximately the largest cross-sectional area of fluid flow through said fluid flow channel, stop means in the form of interengaging surfaces on said diaphragm disk and a portion of said body for limiting movement of said diaphragm disk and said rod in a direction toward said first valve seat means, said predetermined position being established by said stop means, said locking element being axially movable relative to said rod to enable said locking element to move against said first valve seat and prevent fluid flow through said fluid flow channel in a direction reverse to said intake direction.

* * * * *